US007513840B2

(12) United States Patent
Latella, Jr.

(10) Patent No.: US 7,513,840 B2
(45) Date of Patent: Apr. 7, 2009

(54) CLUB SWING TRAINING METHOD

(75) Inventor: Frank A. Latella, Jr., Wilton, CT (US)

(73) Assignee: Catrock Group, Inc., Darien, CT (US)

( * ) Notice: Subject to any disclaimer, the term of this patent is extended or adjusted under 35 U.S.C. 154(b) by 0 days.

(21) Appl. No.: 11/809,491

(22) Filed: Jun. 1, 2007

(65) Prior Publication Data

US 2008/0039291 A1 Feb. 14, 2008

Related U.S. Application Data

(62) Division of application No. 10/137,798, filed on May 2, 2002, now abandoned.

(51) Int. Cl.
*A63B 69/36* (2006.01)
*A63B 21/06* (2006.01)

(52) U.S. Cl. ..... 473/409; 473/219; 473/266; 482/109

(58) Field of Classification Search ..... 473/207–220, 473/226, 227, 231, 266, 276, 277, 409, 422, 473/615; 482/109, 124
See application file for complete search history.

(56) References Cited

U.S. PATENT DOCUMENTS

| | | | | |
|---|---|---|---|---|
| 4,623,146 | A | 11/1986 | Jackson | 482/126 |
| 5,150,901 | A | 9/1992 | Stawicki | 473/215 |
| 5,242,348 | A | 9/1993 | Bates | 482/105 |
| 5,269,528 | A | 12/1993 | McCardle, Jr. | 473/409 |
| 5,308,075 | A * | 5/1994 | Theriault | 473/279 |
| 5,362,059 | A * | 11/1994 | Grossman | 473/228 |
| 5,441,271 | A | 8/1995 | Briggs | 473/215 |
| 5,839,968 | A | 11/1998 | Latella | 473/219 |
| 5,984,795 | A | 11/1999 | Stafford | 473/206 |
| 6,050,902 | A * | 4/2000 | McCrink, Jr. | 473/168 |
| 6,068,580 | A | 5/2000 | Myers et al. | 482/93 |
| 6,176,790 | B1 | 1/2001 | Latella | 473/219 |
| 6,254,493 | B1 | 7/2001 | Wurster | 473/220 |
| 6,296,577 | B1 | 10/2001 | Trammell et al. | 473/340 |
| 2001/0001094 | A1 | 5/2001 | Panes | 482/93 |

FOREIGN PATENT DOCUMENTS

| | | |
|---|---|---|
| JP | 43-030342 | 12/1968 |
| JP | 62-012197 | 1/1987 |
| JP | 09-285509 | 4/1997 |
| JP | 2000-503224 | 3/2000 |

OTHER PUBLICATIONS

International Search Report for International Patent Application No. PCT/US03/13914, dated Oct. 3, 2003, 4 pages.

* cited by examiner

*Primary Examiner*—Nini Legesse
(74) *Attorney, Agent, or Firm*—Boston IP Law Group

(57) ABSTRACT

A method of swing training for a sport requiring swinging of a sports implement including repeated performance by a trainee of at least one swing drill. The swing drill including execution of the following steps: (a) gripping a first elongated spacer between two hands and parallel to a floor; (b) swinging the first elongated spacer in a backswing motion and an opposed downswing motion to bring the first elongated spacer parallel to the floor; and (c) swinging the first elongated spacer in a follow-through motion to an opposite side and an opposed downswing motion, wherein a foot of the trainee is positioned on a second spacer placed on the floor, the second spacer being a pliable object to destabilize the trainee.

23 Claims, 8 Drawing Sheets

Beginning Drill 1

Intermediate Drill 1

Intermediate Drill 2

Advanced Drill 1

Advanced Drill 2

Advanced Drill 3

Advanced Drill 4

Advanced Drills

CLUB SWING TRAINING METHOD

RELATED APPLICATION

The present application is a division of U.S. application Ser. No. 10/137,798 filed on May 2, 2002 and entitled "Club Swing Training Method," which is incorporated by reference herein in its entirety.

TECHNICAL FIELD

The present invention relates to a method for swing training, and more particularly, to a method of training to improve sport specific proprioceptive demands of the muscle physiology in order to correct faulty swing mechanics. This involves utilizing unique stretching and stability exercises that control the neuro-physiological properties required to train muscles in order to acquire the desired biomechanical/physical conditions for the execution of a proper swing. A number of popular sports including golf, tennis, baseball and hockey require the arms to swing while holding an elongated striking implement, for example a club, bat, or racquet, for the purpose of hitting an object. Fishing employs a comparable action to cast a lure into the water.

BACKGROUND

Although many swing training methods and devices are known in the prior art, no known method or device is fully effective in improving athletic performance and preventing muscle dysfunctionality.

Muscle injuries are common to athletes as a result of repetitive and unusual strain on various muscle groups. This problem is often more pronounced in sports such as golf, baseball, and tennis where a good swing is an essential component of the sport. A poor swing training technique leads athletes to inconsistencies in their game, and may lead to injuries as well as to poor execution of the athletic task. Prior attempts to overcome these problems have included various stretching exercises as well as weight training and plyometrics to strengthen and tone muscles. Although these exercises help to increase muscle flexibility, these methods have not provided all the improvements trainees seek from training methods due to lack of adequate proprioceptive innervation (stimulation) and stability in swing position.

In golf, existing methods often overcomplicate the function as to the swing plane and preferred club positioning, while underestimating the importance of proper setup and how it affects swing mechanics. In fact, many of these existing methods simply reinforce poor mechanics because they fail to address the neuromuscular demands that indeed cause physical swing faults. Trainees who have tried to improve their swings have often given up, commenting that their feel is compromised by the distraction of bearing in mind the many technical points needed to make the adjustments required to correct the faults in their swing. This is due to the misnomer of "muscle memory." The patterns of movements can be trained and indeed altered to correct for improper physical flaws. However, in the existing methods, the improper techniques are in fact reinforced through the use of external restraints without training the body naturally to overcome improper physical swing form. The central nervous system stores repeated patterns and thus a method utilizing techniques that train the central nervous system is key to improving the swing.

Physiology

To better understand the problems of providing an effective swing training method, it is helpful to understand the kinesiology involved with the movement of the body when executing a swing. The bones and joints form a system of levers in the human body with the muscular system providing force and movement to the levers. There are two types of joints: hinged joints that flex and extend the limb and ball and socket joints that rotate the limb in one direction or another. Every joint is moved by at least two opposing sets of muscles.

It is clear that if both opposing muscle sets contract together equally there will be no movement of the joint. Conversely, the greatest amount of power will be generated when one set controls and the opposing set is in a state of complete relaxation. Put another way, the force of a concentric contraction of a muscle can be enhanced if it is immediately preceded by an eccentric contraction by the same muscle. A concentric contraction has a line of action passing through the center of the joint, and therefore does not urge rotation, while an eccentric contraction is off-center and urges the joint to rotate. A complete state of relaxation cannot be reached if the muscles are not flexible. Therefore, it is important to note that muscle tightness can affect the execution of any movement.

Energy may be stored in a muscle in the form of elastic energy. When a contracting muscle is forced to stretch, some of the work done in stretching the muscles is available in the following contraction. Maximum reuse of stored energy will follow if the contraction immediately follows the stretching. This type of contraction yields more power, more speed and more efficiency.

Undesired muscle tensions also increase as the body tries to restore lost balance or make other compensators for errors, so that reducing mistakes made in the initial setup and early in a swing will keep the player relaxed and swinging freely. To this end, it is important to understand the proprioceptor. The proprioceptor is a sensory receptor that detects the motion or position of the body or a limb by responding to stimuli arising within the organism. The proprioceptor is found chiefly in muscles, tendons, joints, and the inner ear. Proprioception, as it relates to exercise, is the ability of the brain to recruit the proper muscle groups needed to counteract any outside force. The brain is able to propriocept, or assess, how the body is positioned and properly process that information in order to control the body into the next position. For proprioception, the brain gets its stimuli from the muscles, eyes and ears.

Since stability and balance can greatly affect a player's swing performance, it is paramount that the training method address the neuromuscular physiology behind the swing motion in order to meet the sport specific demands of the swing. Therefore, there is a need not only to stretch and selectively train groups of muscles to prevent dysfunctionality and improve overall performance in athletic activities but also correct faulty swing mechanics by requiring a swinging skill by training sport specific proprioceptive demands of the muscle physiology.

There have been previous attempts to train muscle groups selectively to prevent dysfunctionality and to improve overall performance in athletic activities.

THERABRAND™ elastic band, an elastic band attached to a wall was developed to provide specific eccentric training intended to enhance muscular recovery following pitching in baseball or softball, thus reducing muscle soreness. Isotonic exercises are performed with the elastic band which is used to add resistance to strengthen isolated muscles by increasing the work applied on the muscles.

Because of the limitations of the THERABRAND™ elastic band mechanics, it appears that the subjects were not able adequately to duplicate the actual motion of a baseball swing. Thus, the apparatus and related method do not even recognize the need to train the proprioceptors needed for adequate swing training so that the subject may be able to repeat good swing techniques. Rather, this device is limited in it use for stretch training to develop muscles for general use.

The Ecosque Method attempts to correct dysfunctional muscle control through a series of several exercises designed to strengthen muscles used in athletic activities including golf. One drawback of the Ecosque method is that it is not adequately specific for golf. Diagnostic testing is used to try to pinpoint specific problem areas, where muscle flexibility is limited. The method provides stretching exercises using a T-bar and some weight training. The method does not appear to help a golfer or other athlete maintain a proper swing plane and improve the mechanics of a sports swing.

Neither method seems to tailor the exercises specifically to the needs of trainees. Furthermore, the methods do not appear to obtain any benefits from training proprioceptors so that the body can learn and repeat the good swing techniques. Therefore, there is a need for a method of swing training designed to meet, inter alia, the specific needs of golf, where the player or trainee can strive for the execution and maintenance of an ideal or desired swing plane.

Latella, in U.S. Pat. No. 5,839,968, (hereinafter "Latella '968") discloses a swing training method using a series of exercises which includes one or more balls of varying sizes, weights and pliability gripped at strategic body locations between an arm/body or legs. Specifically, Latella '968 discloses methods including gripping a supportable spacing object between a limb and another body component, holding another object between the hands and executing a swing motion while gripping the spacing object to support it. Latella '968 fails to disclose a simple method with a minimum amount of moveable objects and parts such that the core muscles used in a golf swing are strengthened. Moreover, Latella '968 fails to provide a method that focuses on improving a trainee's balance and stability during a swing motion, and instead teaches a shifting of weight from one foot to the other. In fact, Latella '968 does not recognize the importance of training proprioceptors so that good swing techniques may be maintained. The Latella '968 method's use of compressive objects placed between joints and limbs in fact restrict movement, balance, and stability such that a smooth swing motion remains difficult to accomplish and even more difficult to repeat.

Various loops, tethers, cuffs, harnesses and the like have been proposed for training trainees by physically constraining one or more body movements. These devices may be awkward to use or inconvenient to attach and, while each presumably supplies some benefit, none satisfactorily trains a trainee to have a precise and powerful swing employing simple training aids while focusing on stability and proper form to avoid back and spinal injuries.

For example, Radakovich, in U.S. Pat. No. 5,149,909, discloses a golf club swing training device and method employing an elastic loop worn around the neck, chest and hips which is intended to correct the trainee's golf swing. The elastic loop is donned over the head of the player with the major portion of the loop resting over the chest, abdomen and shoulders. The player swings against an upward pull exerted by tension in the elastic loop to produce improved control of the trainee's arms. Radakovich's device does not appear adequate to meet the specific need for training, stretching or preparing muscles for a precisely executed golf swing. For example, Radakovich's training device and method does not prevent a flying right elbow, arms separating or casting of the club. Nor does Radakovich's device train the trainee to properly position the hips, legs, knees and feet. The method does not necessarily increase shoulder turn, cause any separation turn and trunk rotation, and does nothing to train the lower body, which are desirable training requirements. Radakovich's method emphasizes left hand and left arm movements for right handed players. Furthermore, Radakovich's method does not correct arm position at the top of the backswing, correct posture, correct weight disbursement, or help coordination and stability throughout the swing plane. Nor does Radakovich's method address physical limitations of individual trainees, for example if a person lacks the flexibility to turn the shoulders and hips, separately.

Leith, U.S. Pat. No. 5,174,575, discloses a harness to be worn by a golfer while making practice swings which harness restricts the golfer's arm and hand movements. Leith's device may provide some control of the hands and arms in relation to the club, but it appears to do little or nothing to control and train other components of the golfer's body that are important to the swing.

According to Leith's disclosure, a flexible strap or a rigid rod is attached to a point on the shaft of the golf club, just above the club head, and extends to a point on the golfer's forearm where it is adjustably fastened. The position on the arm is adjustable. The device appears to be intended to support the arms to keep them straight just before impact, and does not appear to constrain other body components. The lack of restriction of movement in other areas of the body appears to prevent effective muscle memory training. Nor does Leith address the issue of muscle stretch training in significant areas of the body such as the hip, arm, shoulder and leg areas. Furthermore, Leith's harness does not help increase the range of motion or the flexibility of the shoulders, hips and trunk. Nor does it prevent many common faults such as flying right elbows, twisting and bending of the knees, and twisting of the legs. Nor does the device address a player's physical limitations or lack of conditioning. Leith's methods do not provide adequate training for golfers desiring a significantly improved swing.

Johnson, U.S. Pat. No. 5,295,690, appears to control and perhaps train somewhat more of the golfer's body than does Leith but does little or nothing to train other body components important to the swing, for example the legs.

Johnson discloses a golf swing device including two elastic arm cuffs which are interconnected, and which each fit on one of the golfer's arms such that the golfer's arms are biased towards each other while executing a golf swing. An elastic hip strip is connected to the arm cuff holding the trailing swing arm and includes a clamp which is secured to a point in proximity to the golfer's hip which is on the opposite side of the golfer's body from the golfer's trailing swing arm. Johnson's device appears to restrict arm movement, possibly relative arm and hip movement and, to a degree, wrist movement and to keep the elbows together throughout the swing, which may or may not be effective in preventing a flying right elbow, but does not appear to train the lower body. Furthermore, some of the restrictions imposed by Johnson's rather complex restraining device may even hinder desirable results such as training the proprioceptors for the relevant muscles so that the body can replicate the correct movements.

Hundley, U.S. Pat. No. 5,301,948 discloses a complex free-standing apparatus for golf swing training which controls the movement of the head of a club to force the golfer to maintain one swing plane. Reportedly, the Hundley device allows the trainee to imitate the hand movement used in a proper golf swing, as well as allowing for the full extension of the golfer's arms in follow-through. This device comprises a system of articulated arms including a swing element, a swing plant adjuster element, and in upright post-and-base element to support the movable elements from the floor. The device also uses in adjustable counter-balance connected to vary the loading with a view to developing muscles required in golfing. The biomechanics of the swing lack muscle group specificity and lower body training is not effectively addressed. In addition, because of the strong physical restraints imposed on a golfer's limbs, without supervised use, the device may actually lead to muscular dysfunction or minor injury with inappropriate muscle movements and weight distribution to the back and legs.

Perry et al, U.S. Pat. No. 5,303,927, discloses a golf training device including a hip belt and an elastic cord where one end of the elastic cord is attached to the belt and the opposite end is attached to a stirrup for receiving a foot of the golf player and method using the same. The stretched cord is designed to create a rotational torque at the hips of the player to assist the player in maintaining a good body stance and properly turning the hips as required for a good swing. Perry's device is designed to induce the trainee to perform the proper turning of the hips during swing. The device seems to restrict hip movement by inducing good rotation while restricting arm movement. However, it is not clear from the disclosure if the arm is guaranteed to swing back in the exact plane desired to achieve maximum effect. Furthermore, There is no restriction of the legs and knees which may twist and turn or be spaced awkwardly apart. No time mechanics are addressed since the upper torso and limbs are totally unaffected. Finally, the Perry's cord may get in the way of good mechanical use of legs. The novice golfer using Perry's device would have difficulty with the proper placement of the feet, and the positioning of legs and hips.

Dorotinsky et al, U.S. Pat. No. 5,308,074, discloses a golf swing training device having an adjustable belt, intended to be worn around the waist, which belt is attached to one end of a resilient cord, the other end of which is attached to a stake which is affixed to a ground mass. The cord is designed to stretch during the trainee's backswing and retract during the trainee's follow-through and the device is intended to guide the golfer's hips and body. However, there is no upper body training, no control of upper torso, shoulders, hands and arms to keep appropriate positions throughout the swing. Nor does Dorotinsky's device address body stability, coordination and flexibility. In addition there are drawbacks to Dorotinsky's methodology so far as it relates to the hips. For example, Dorotinsky's device cannot guide the golfer through the entire sequence of hip rotation involved throughout the swing because it is inherently a one-sided training method which works only on hip rotation in the back swing (or possibly, only in the follow-through). Furthermore, since the device pulls the trainee, it does not allow them to work against resistance in the follow-through nor in the finish. Dorotinsky further fails to recognize or address the dangerous effects of improper hip rotation on the spinal chord and lower back.

Grossman, U.S. Pat. No. 5,362,059, discloses a training device consisting of a flat rectangular framework around air resistant material, which framework is attached to a handle gripped by a swinger. Grossman's object is to provide a variable amount of air resistance to simulate muscle forces felt in an actual golf swing. The amount of drag is determined by the nature and extent of the material within the framework. A further stated object is to train swinger's muscles for good swing motion. However, Grossman does not seem to ensure good positioning of the wrists. Nor does Grossman appear to provide any control of foot and leg position nor address the problems of a flying elbow, heading knees and other unnecessary movements. Furthermore, Grossman's device presumably will not build muscle since there is insufficient muscular overload to require any significant muscle memory not exactly trained.

Other than Grossman and the Ecosque exercises, the above-described swing training methods depend upon the use of a restraining device to physically limit the free range of movement of some part of the golfer's body. Such devices offer some risk of jarring and perhaps injuring muscles or tendons if the imposed limit is reached suddenly. Such devices are designed to oppose and physically limit specific muscular activity responsible for undesired movements during the swing. Because physical restraints prevent a group of muscles from executing certain undesired movements while repeatedly practicing a swing, there is no guarantee that bad habits will not be resumed when the restraints are removed. Historically, the training process has focused upon the improvement of muscle strength, endurance and flexibility without consideration to the role of the neuromuscular system. It would be desirable to provide a swing training method where the body naturally constrains itself, by its own, unfettered muscular exertions to avoid undesired movements and which method preferably enhances the ability of the body to repeatedly perform desired movements. It is believed that this cannot be achieved without inclusion of proper proprioceptive training methods. Moreover, many of the aforementioned methods neglect to appreciate the complete physiological concerns of golf swings in order to teach techniques that avoid lower back and spinal chord injuries.

Therefore there still exists a need for a training method which is simple, inexpensive, biochemically specific to a desired or preferred swing pattern, and also takes into account the importance of training the neuromuscular system to aid the body in repeating proper swing movements while avoiding the dangers of lower back and spinal injuries due to improper hip rotations and improper balance/stability.

SUMMARY OF THE INVENTION

The present invention provides a method of swing training for a sport requiring swinging of a sports implement, the method comprising repeated performance by a trainee of at least one swing drill, the at least one swing drill including execution of the following steps:

a) gripping a first spacer between the hands and parallel to the floor;

b) swinging the first spacer in a backswing motion and an opposed downswing motion to bring the first body spacer parallel to the floor; and c) swinging the first spacer in a follow-through motion to an opposite side and an opposed downswing motion.

DETAILED DESCRIPTION OF THE INVENTION

Figure 1A:
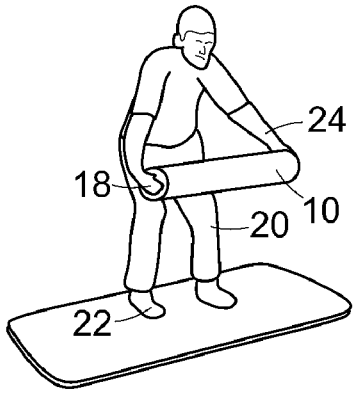
FIGS. 1A-1F provide a view of a trainee practicing the method of the present invention for the Beginner Drill 1, using a first spacer to perform a series of swings.

The present invention includes certain novel physiological discoveries, observations, or insights relating to the achievement of a preferred swing of the arms for use in golf and other sports and activities employing a repetitive arm swinging motion where the accuracy, efficiency or power of the swing are important. While no device or method can guarantee success or improvement in the performance of a particular sport for every trainee, and the present invention does not provide any such guarantees, it is believed that the methods of the present invention, when practiced as described herein, will enable many people to learn good golf skills relatively easily, or to improve their existing skills significantly while avoiding common injuries related to improper golfing methods. The methods of the present invention can be beneficially applied to other sports and activities, with appropriate adaptations, as will be apparent to those skilled in the art, through their unique ability to train new patterns of movement that are learned by and in the different levels of the central nervous system. Specifically, the present inventive methods train new patterns in the levels coordinating muscle innervation, viscoelastical properties, balance, and stability.

The following description will refer to a male, right-handed trainee, by way of example, who will be assumed to be about six feet tall and about 175 pounds. The invention is of course applicable to women trainees, left-handed trainees and trainees of most heights and weights. Suitable adjustments or modifications of the invention for such other trainees will be readily apparent to those skilled in the art.

According to the findings of the invention, a swing training method should be biomechanically specific to an idealized or sport-characteristic swing pattern, which is expected to provide good performance. The swing training method disclosed herein, in preferred embodiments, is a sport-specific technique intended to train individual muscle groups naturally to perform specific components of a desired or preferred swing pattern, and possibly also to compensate naturally for mechanical disadvantages caused by a player's or athlete's bad habits or physical limitations. Furthermore, the present invention discloses a swing training method which provides better stability by utilizing a minimum amount of moving parts and avoiding movements which normally cause lower back and spinal injuries by specifically focusing on stability throughout the movements.

Many known training methods for golf, or other sports, emphasize the development of muscle strength, with or without mechanical aids, by repeatedly contracting selected muscles against a resistance. Some examples of training methods used for many sports include weight-lifting and bicycling. Swing training requires good control as well as muscle strength, or power, and to this end, some known training methods, for example, as described above, add constraining means to control the movement of body parts that some individuals have difficulty in properly aligning for the desired swing. In most prior methods little, if any, emphasis is placed on the need to improve the influence of specific neuromuscular demands of the golf swing.

Proprioception, coupled with Kinesthesia (the sense of joint motion and acceleration) are keys to the consideration of each exercise in the present invention. These components lend strength and control to the movements by improving the body's ability to maintain stability with increased flexibility of the muscles. Feedback from receptors in the joint, ligaments, tendons, and muscles train motor unit synchronization. The methods of the present invention address neuromuscular demands which form and control strength and positioning of specific muscles used in the swing. Inter alia, the invention is designed to impose proprioceptive demands that help train the central nervous system to store repeated patterns, thereby eliminating, or at least reducing the otherwise confusing swing thoughts golfers may experience.

Specifically, the present invention is designed to increase the mechanical advantage obtainable with the leverage system of the body. The present invention utilizes methods to selectively elongate core muscle that play a primary role in any swing by regulating motor control and synergistic patterns of muscle contractions. The drills and exercises of the invention can also help break down resistance to such muscle elongation through the joint position sense and proprioceptive patterns utilized in the methods of the present invention The joint stability concept involves accomplishing a balance of the correct amount of motion in the correct plane, at the correct time and at the correct joint. With this in mind, "hip" mobility and stability is of paramount importance. At the knee and ankle, stability is important due to the ground reaction forces in swinging. Hence the present inventive methods train from stable to unstable drills to reinforce the concept of stability and flexibility, which is more indicative of what is happening, sport specifically, in the swing.

Emphasis is then placed on as large an amount of motion as an individual can control "influenced" by proprioceptive information based on collective kinesthesia, vestibular, and visual information. Because of the nature and quality of input from these sensory systems, all of these components must be, and are, incorporated into the present invention.

Preferred training methods according to the invention, train an elastic component of muscle tissue to enhance the elongation of selected muscles or muscle groups and provide a significantly improved mechanical advantage in the forces applied to the golf ball. A preferred methodology of the invention employs a combination of drills or exercises which provides a sequential stretching of each muscle group involved in the swing while maintaining stability and minimizing movements to concentrate on core muscles through the novel proprioceptive methods described hereinabove.

The biomechanics of a golf swing may be analyzed into a number of component actions. Important swing component actions are rotations of the shoulder, the torso, the midsection and a stretching of the legs. The rotation of the shoulders stretches the torso muscles; the rotation of the torso stretches the midsection muscles; and the rotation of the midsection stretches the hips. However, it should be noted that in the present invention, the methodology provides stability and controls the rotation of the hips to help prevent lower back and spinal injuries.

Key elements of good golfing skills lie in the movements of the torso and arms while swinging, and an ability to focus the eyes on the head of the club hitting the ball rather than in the intended direction of travel. The length of a trainee's drive is only partially determined by the force put into his shot. Important additional factors are an ability to maintain stability while maintaining a preferred swing plane throughout execution of the golf swing and the leverage applied.

Terminology

As illustrated in FIG. 1A complete golf swing has three component swing phases: a backswing BS, the movement from address, over one shoulder, to the top of the swing; a downswing DS, the movement from the top of the swing to the point of contact; and a follow-through FT, the movement from the point of contact over the other shoulder to the end of the swing.

As used herein a "preferred swing plane S" refers to a desirable plane of travel for a golf club as it moves in a golf swing and is a hypothetical plane defined by the movement of a line L passing along the length of the shaft. The "swing trajectory" is the actual path followed by the hands, shaft and club which need not be, and usually will not be planar. It is difficult to execute a swing on the preferred swing plane. Ideally, throughout the complete golf swing, a line passing through the hands, shaft and club head remains in a single plane. This is virtually impossible to achieve, but is a valuable objective.

While the swing is most effective when trainees swing on the preferred swing plane, very few trainees are consistently able to do so because the effort is so demanding and considerable precision is required. Furthermore, body limitations, such as a lack of flexibility, make it difficult to reproduce a consistent swing pattern on a desired plane.

As used herein, the "swing arc" is the part-circular line defined by rotation of the fully extended left arm holding the club of choice about the left shoulder. The size of the swing arc is dependent upon the club used, so that the smaller the club, the smaller the swing arc. The swing arc is an idealized concept which cannot be fully attained in an actual swing.

As used herein, the "swing path" is the actual path on which the club head travels through the swing, which may be good bad or indifferent in any given swing. It is desirable for the swing path to coincide with the swing arc at the point of contact with the ball. Solid extension of the left arm while pushing the club into the preferred position starts and maintains a desirable swing path. Starting the club head on the preferred swing path initiates good timing and starts to build club head speed by providing a start to a maximum swing path.

Positioning or Setup for a Golf Swing

Starting body alignment or address is important to execution of a good swing and is preferably adopted in performing the exercises and drills of the present invention. Good alignment begins with the transverse body lines through the shoulders, hips, knees and feet respectively extending parallel to a target line on which the ball is to travel. A center line between the shoulders, hips, knees and feet should aim just to the left of the target, or intended point of contact of the club head with the ball, with the leading edge of the club face set perpendicularly to the target line. The club should be set with the club head on the center line and with the shaft vertical and parallel to the center line, defining a desired shaft angle and shaft plane with it.

The placement of the trainee's feet before the swing is closely linked with the way he generates power during the swing. A preferred foot placement is obtained by setting the insides of the heels approximately shoulder width apart. If the stance is too wide, then turning freely and fully becomes difficult while if the stance is too narrow the trainee may lack stability and balance. Good balance reduces excessive muscle tension. Additionally, the trainee's knees should be slightly flexed to lower the center of gravity and keep the balance. This stance is helpful in several respects: in producing good torso rotation; in stretching the leg extensor muscles; in flattening the swing trajectory to conform more closely with the preferred swing plane; and in gradually absorbing force in the follow-through.

Execution of the Swing

In the backswing, the club head, the hands, and the shoulders should start in one motion. This is more easily accomplished and controlled with proper stabilization and joint awareness supplied first at the core muscles. At the top of the backswing, the left arm should be above and parallel to the shaft plane created at address, and the club shaft should point just to the left of the target, on the target line. This posture optimizes the probability that the energy of the hips, shoulders, arms and hands will be released in the correct order, and a desirable chain reaction will result.

The position and motion of the wrists are also important factors in attaining maximum club head velocity. Uncocking of the wrists too early in the downswing will decelerate the arm motion, and decrease the angular velocity of the entire swing. Therefore, it appears that controlling the uncocking of the wrists to occur at an appropriate moment of the downswing is an important mechanical element of the swing. Again, proper stabilization and joint awareness supplied first at the core muscles can facilitate such control.

Conforming closely to the preferred swing plane during the backswing helps the upper body and arms to be properly inter-aligned to pre-group forces so that each muscle group functions in a preferred sequence. The torso sets the club head, the hands, arms and shoulders in motion. The hands move the club and the swinging of the arms turns the shoulders. The downswing is inaugurated by the turning of the pelvis to unwind the upper part of the body. The muscles of the chest, shoulders, arms and hands flow easily into the swing, without interference between their individual motions, pursuant to what may be referenced as a "summation of forces" principle.

Since it is the club head's momentum that drives the ball, the higher the velocity of the club head, the further the ball will go. The club head may be considered to be set in motion by the body's musculature operating the osseous system as a series of levers, firmly articulated together, and functioning as a composite whole. The further away from the club head the power is applied, the more rapidly the head will move. The longer the lever provided by the arms, and the greater the arc determined by shoulder turn and trunk rotation, the greater the velocity of the club head. Also the nearer to the feet the power is applied, the more rapidly the club head will travel.

The more powerful muscles of the back, hips and legs are not used as much as the weaker muscles of the shoulders, arms and wrists. The longer the path taken by the club head in the backswing, the longer and flatter the downward swing trajectory path is likely to be. There are a variety of external anthropometric and biomechanical factors which can vary from person to person performing a golf swing. Flexibility, coordination, balance, strength and the ability to develop specific movements of the lower torso, trunk, hips and shoulders can all affect swing performance.

Pursuant to these principles, the present invention provides easily performed training methods and drills employing very simple apparatus, such as ordinary cylinders and balls and the like to control and work specific muscle groups to produce/promote a swing on a plane while maintaining stability and minimizing lower back and spinal injuries.

Drills and Apparatus

Some exemplary exercises and drills embodying the invention and which will be described in more detail hereinafter employ, in various modes and combinations, a number of items of training apparatus. In preferred embodiments, the training apparatus comprises multiple spacers, namely a large cylindrical object and a medium semi-cylindrical object to control the behavior of various body components during practice swings and drills, notably to prevent erratic limb movements and to help isolate the actions of different groups of muscles while maintaining stability and reducing risks of injuring the lower back and spine. Other simple apparatus such as a rigid bar and a tension belt can also be used to supplement or enhance the drills. A plurality of pliable objects are also used, including at least one small disc and at least one large ball for supporting the knee during the kneeling drills and to provide a seat during the seated exercises, respectively. The following are some examples of suitable dimensions and other characteristics for these various items of training apparatus.

Referring to the FIGURES, a preferred first spacer 10 should be suitable for gripping between the hands while swinging and can have a diameter of from about 10 cm to about 60 cm., preferably about 20 cm. to about 50 cm., depending upon the physiology of the trainee. Depending on the level of skill of the trainee, the weight of the spacer can be varied. The action of gripping such a spacer between the arms while swinging helps isolate the swing movements from unwanted hip movements. Specifically, the spacer provides the freedom of the joints in the body to allow the navel to move to the right, which in turn moves the arms in one sequence, causing the pelvic bone as opposed to the hip to turn in the backswing motion. The elongated spacer 10 and the method of gripping the spacer 10 keeps the wrist in line with the proper plane of motion, thereby reducing risks of wrist injury.

A second spacer 12 having a diameter of from about 4 cm to about 40 cm, preferably from about 6 cm to about 30 cm. is used as an foot support. The second spacer is placed under either one or both feet, serving to provide instability of the lower torso. An unstable surface produces more ground reaction forces on the foot to create more neuron recruitment. Therefore, the body must work harder to keep the core muscles stable during the swing movements while increasing flexibility by training the proprioceptives utilized in the swing movements.

A pliable object 14, intended to be placed underneath the knee during the kneeling exercises, have a diameter of from about 20 cm and about 50 cm, preferably a diameter of from about 25 cm to about 45 cm. It should be noted that the diameter of the pliable object may vary depending on the size and skill level of the trainee. The pliable object provides support to the knee during the repetitive drills and aids in destabilizing the trainee during the swinging motions to once again train the proprioceptives involved in the swing motion.

A pliable object 16 is provided as a large ball for seating the trainee during the seated drills. The pliable object 16 has a diameter of between about 20 cm and about 100 cm, preferably from about 30 cm to about 90 cm, and most preferably from about 30 cm to about 85 cm. The large ball provides a compressible support for the trainee while seated to further aid in focusing the drills on proprioceptive stabilization, strengthening and stretching the desired muscles during the swinging motions. The external instability aids the body in focusing on internally stabilization such that the proprioceptives are trained during the training method. In an alternative embodiment, the user may either lay on the ball or sit on a chair or similar apparatus, as will be known to those skilled in the art.

The weights of the spacers and the pliable objects, or equivalent significantly weighted objects, is preferably selected to provide a comfortable level of resistance that suits the trainee at a given time. With experience and development of swing specific muscle strength, the trainee may adopt heavier spacers offering more resistance.

The particular size of each spacer is preferably selected according to the physiology, and perhaps the skills, of the individual trainee, within the general ranges set forth above, to help comfortably position or guide the club on to a desired swing plane. The judgment as to what constitutes an optimally sized spacer or other implement is probably best made by an experienced instructor. A reasonable degree of comfort is important: the muscles should be worked and stretched, but not uncomfortably strained. In general, subject to variations in proportions, the optimal size of each ball or other spacer object used will correlate with the height of the trainee, so that shorter trainees use smaller balls, and taller trainees use larger ones.

It is contemplated that the methods of the present invention may be combined with, for example, tethering of a ball to the waist or other body part, either elastically or inelastically.

While a variety of spacers and objects is described and shown as being useful implements in practicing drills and exercises according to the invention, it will be appreciated that equivalent objects, articles or devices may be used and provide many of the benefits of the invention, for example, flattened or substantially rectilinear, e.g. cubic objects or bridge-like objects or devices that maintain a desired separation between selected body anatomies, yet will be dropped if not properly gripped.

Preferred drills are performed with the specific actions detailed below. Preferably, the beginner and the advanced player should perform each drill from the opposite side of the body to train the antagonist muscles. By performing the drills both ways, the muscles will be worked eccentrically, assist in greater acceleration and also greater deceleration. Each drill should be repeated about ten times on each side before advancing to the next drill. The number of repeats is not critical and may be varied, for example between about six and about twenty depending upon the trainee, their conditioning, experience with the drills, and so on.

The invention extends to training programs employing preferred combinations of drills, as will be described hereinafter.

Beginner Drill

Figure 1B:
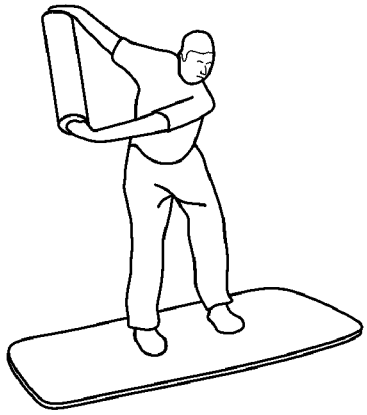

Referring to FIGS. 1A-1F, in beginner Drill 1, the trainee is shown with a first spacer 10 between his hands 18. The knees 20 should be flexed slightly. The feet 22 should be firmly placed with toes forward and knee caps forward, as shown in FIG. 1. To isolate the arm 24 movement, the hands 18 grip outer ends of the spacer 10, as seen in FIGS. 1A-1B. Although not shown, the backswing demonstrated in FIGS. 1A-1B are repeated on an opposite side to aid in stretching out the muscles eccentrically to provide greater acceleration and deceleration in moving a club.

Figure 1C:
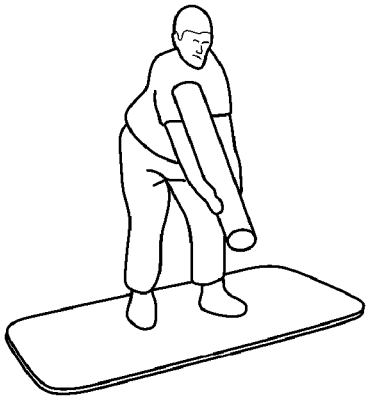
Figure 1D:
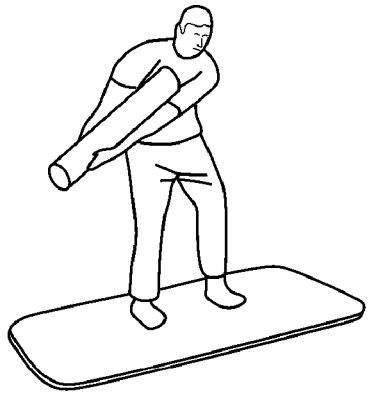
Figure 1E:
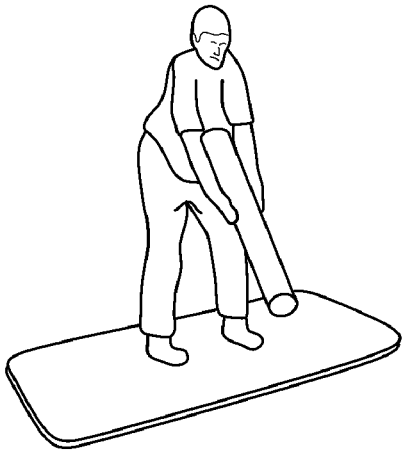
Figure 1F:
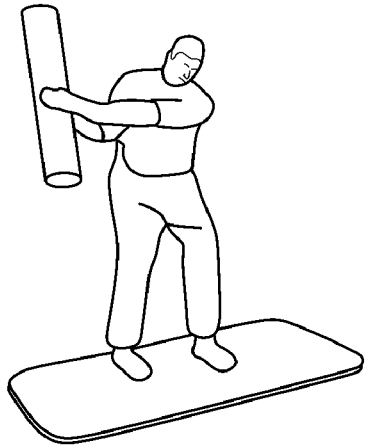
Figure 2A:
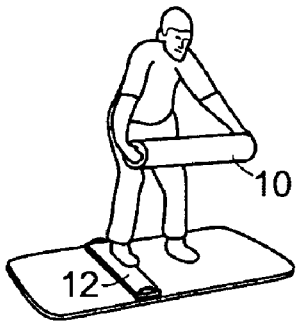
FIGS. 2A-2F provide a view of a trainee practicing the method of the present invention for the Intermediate Drill 1, showing the first spacer of FIGS. 1A-1F and a second spacer placed under one foot while performing the series of swings shown in FIGS. 1A-1F.
Figure 2B:
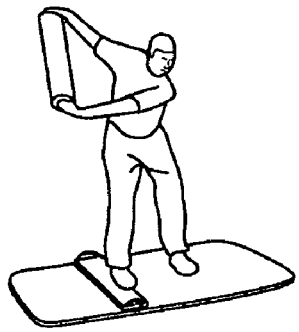
Figure 2C:
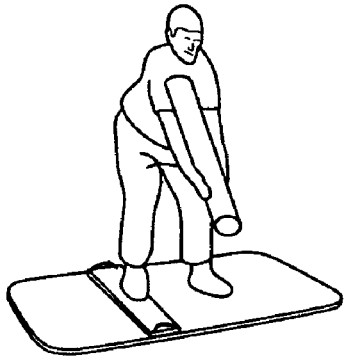
Figure 2D:
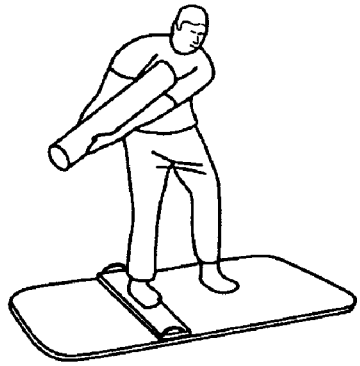
Figure 2E:
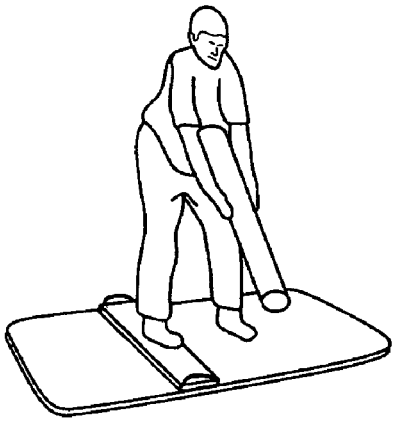
Figure 2F:
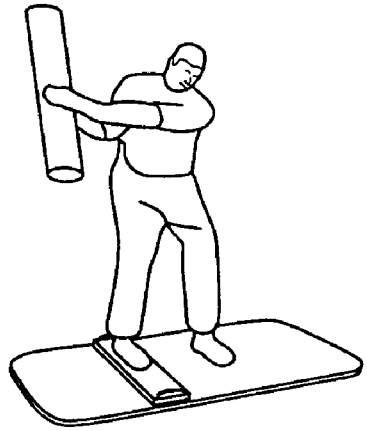
Figure 3A:
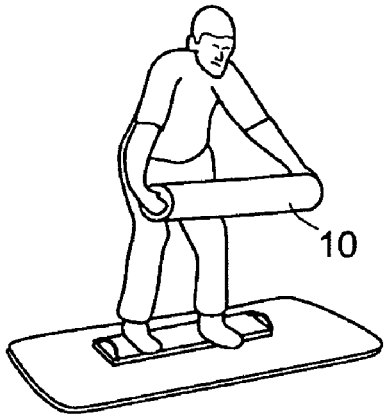
FIGS. 3A-3F provide a view of a trainee practicing the method of the present invention for the Intermediate Drill 2, showing the first spacer of FIGS. 1A-1F and a second spacer placed under both feet while performing the series of swings shown in FIGS. 1A-1F.
Figure 3B:
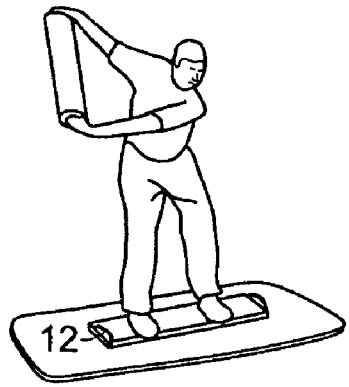
Figure 3C:
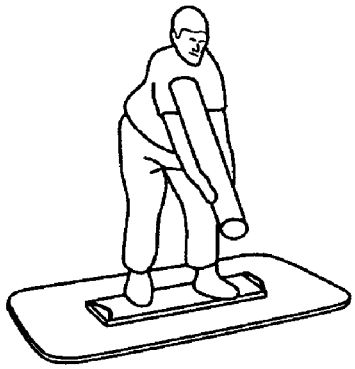
Figure 3D:
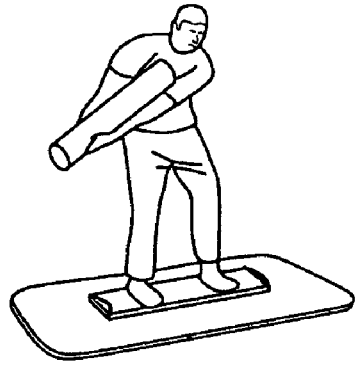
Figure 3E:
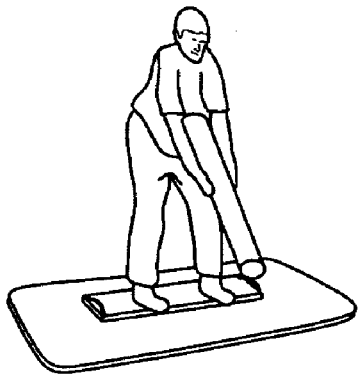
Figure 3F:
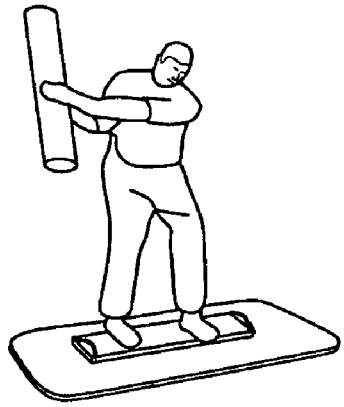
Figure 4A:
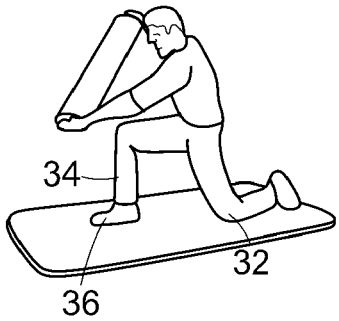
FIGS. 4A-4F provide a view of a kneeling trainee practicing the method of the present invention for the Advanced Drill 1, showing the first spacer of FIGS. 1A-1F to practice the series of swings shown in FIGS. 1A-1F.
Figure 4B:
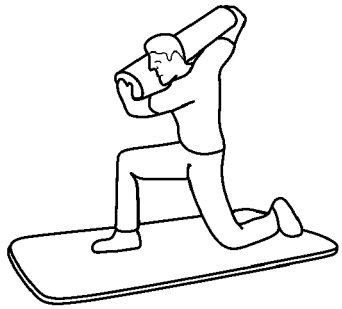
Figure 4C:
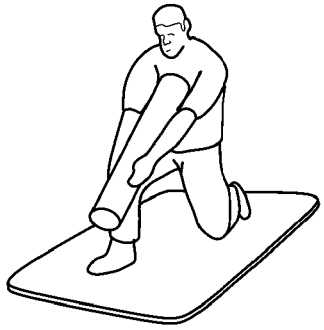
Figure 4D:
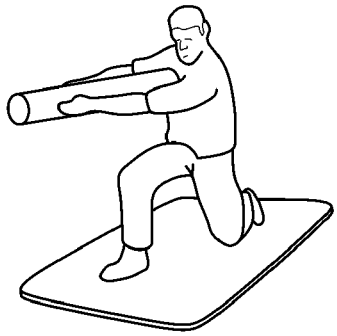
Figure 4E:
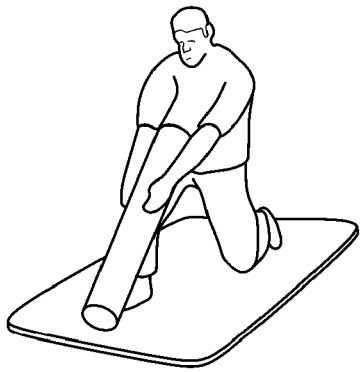
Figure 4F:
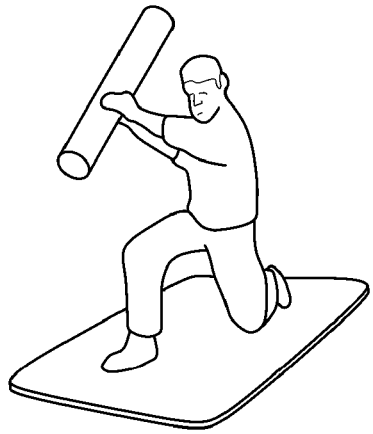
Figure 5A:
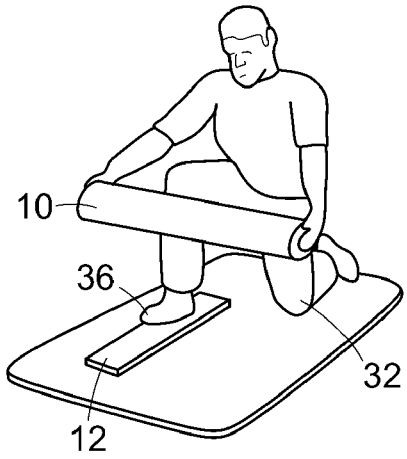
FIGS. 5A-5F provide a view of a kneeling trainee practicing the method of the present invention for the Advanced Drill 2, showing the first spacer of FIGS. 1A-1F and a second spacer placed under one foot while performing the series of swings shown in FIGS. 1A-1F.
Figure 5B:
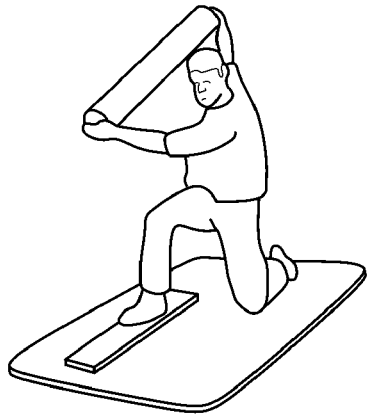
Figure 5C:
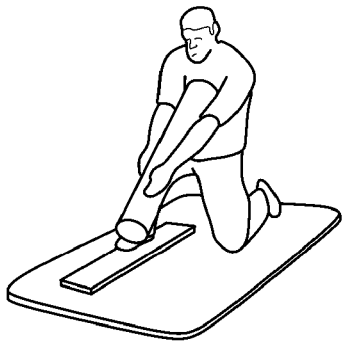
Figure 5D:
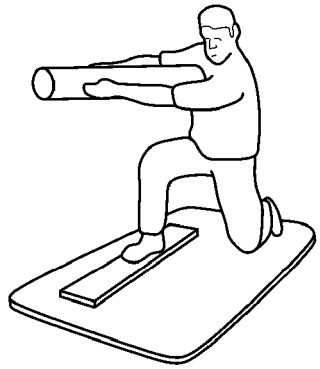
Figure 5E:
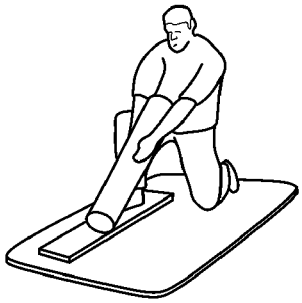
Figure 5F:
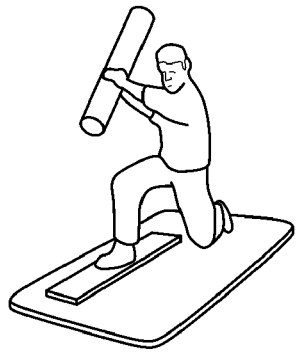
Figure 6A:
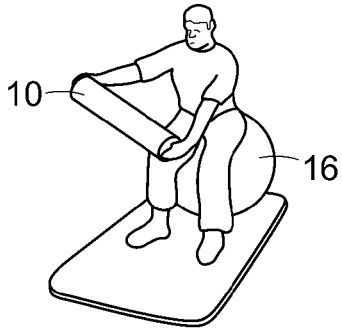
FIGS. 6A-6E provide a view of a seated trainee practicing the method of the present invention for the Advanced Drill 3, showing the first spacer of FIGS. 1A-1F and a pliable ball placed upon which the trainee is seated while performing the series of swings shown in FIGS. 1A-1F.
Figure 6B:
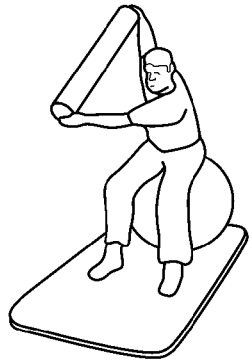
Figure 6C:
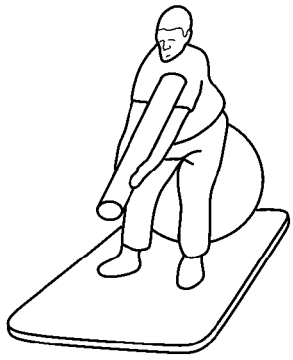
Figure 6D:
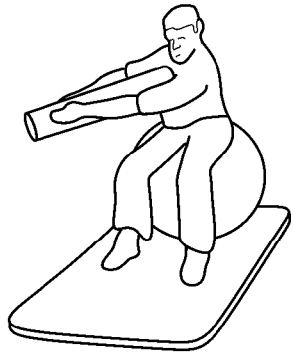
Figure 6E:
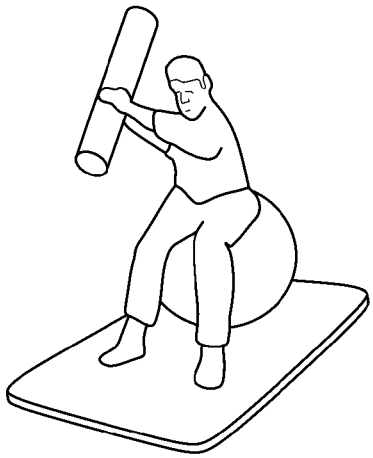
Figure 7A:
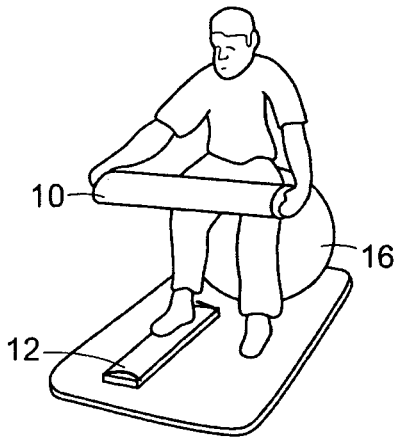
FIGS. 7A-7F provide a view of a seated trainee practicing the method of the present invention for the Advanced Drill 4, showing the first spacer of FIGS. 1A-1F, a pliable ball placed upon which the trainee is seated, and the second spacer placed under one foot while performing the series of swings shown in FIGS. 1A-1F.
Figure 7B:
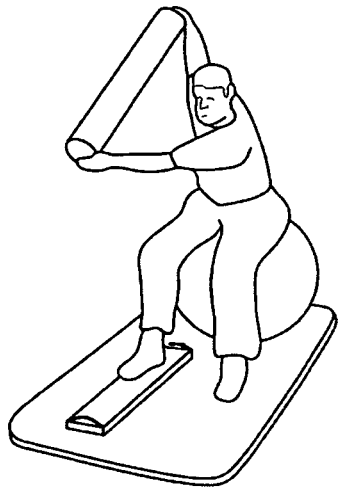
Figure 7C:
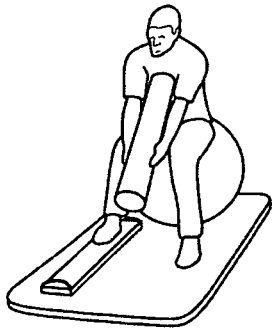
Figure 7D:
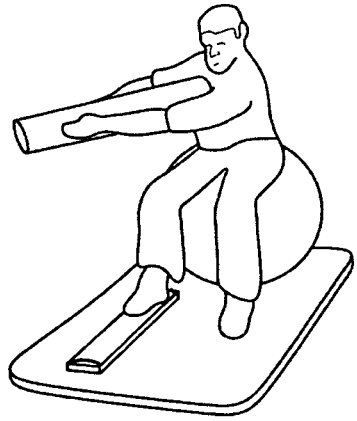
Figure 7E:
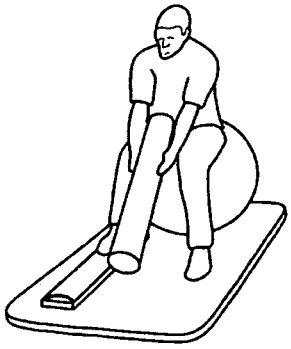
Figure 7F:
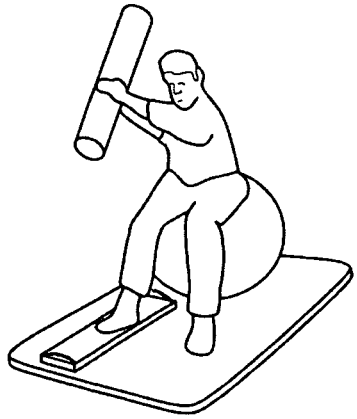
Figure 8A:
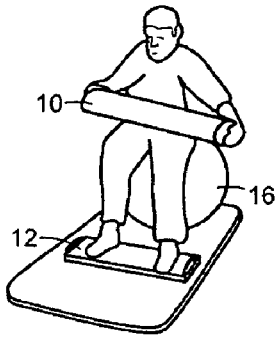
FIGS. 8A-8F provide a view of a seated trainee practicing the method of the present invention for the Advanced Drill 4, showing the first spacer of FIGS. 1A-1F, a pliable ball placed upon which the trainee is seated, and the second spacer placed under both feet while performing the series of swings shown in FIGS. 1A-1F.
Figure 8B:
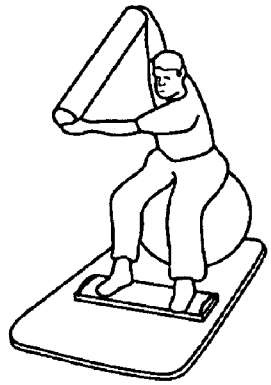
Figure 8C:
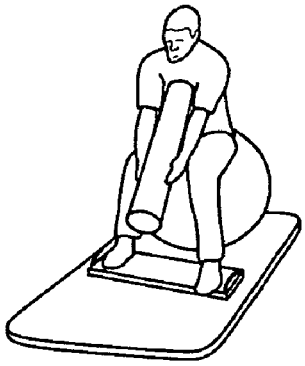
Figure 8D:
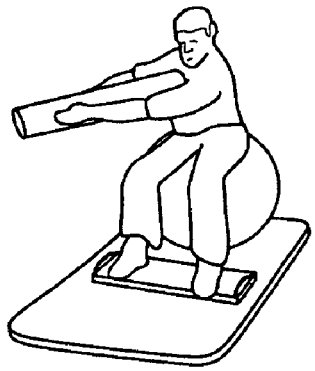
Figure 8E:
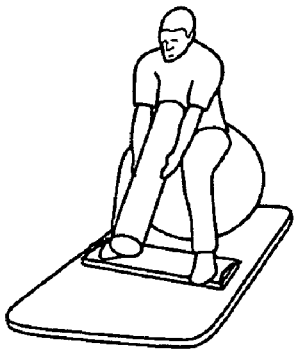
Figure 8F:
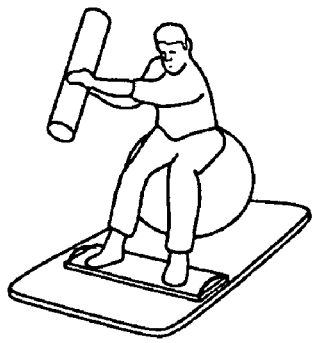

As shown in FIGS. 1C-1D, the drill is repeated with the trainee gripping the first spacer 10 near an end of the first spacer 10 so that a first end 26 of the first spacer 10 is held against the chest and a second end 28 extends longitudinally out and toward the floor. This drill restricts the arm 24 and shoulder movements to provide focus to strengthening and stretching the back muscles. In FIGS. 1E-1F, the drill is again repeated with the trainee gripping a center of the first spacer 10. This allows a wider range of movement on the backswing motion, which can be seen in FIG. 1F. The combination of drills in FIGS. 1A-1F therefore provide a range of motions for both strengthening and stretching the arm 24 and back muscles to prepare the trainee for the golf swing.

Intermediate Drill 1

Referring now to FIGS. 2A-2F, shown therein is a trainee with a first spacer 10 and a second spacer 12 placed under one foot. The second spacer 12 aids in destabilizing the trainee during the drills as well as add a level of difficulty in the swing motions to help strengthen the specific muscles utilized in a golf swinging motion. The instability forces the body to rely internally on establishing stability while increasing flexibility, thereby training the proprioceptors to reproduce new, more efficient joint position involved during the golf swing.

As shown, the swing motions in FIGS. 1A-1F are repeated with the second spacer 12 in FIGS. 2A-2F. Moreover, the second spacer 12 is preferably partially cylindrical so that a top side is curved and a bottom side is flat. In the first repetition, the foot is placed on the top side. The repetition is then repeated with the foot placed on the bottom side. Such shifting not only increases instability during the swing motions, but forces the trainee to maintain a more rigid lower body to allow focus on the upper body muscles. Moreover, the elevated foot allows strengthening of the muscles in the thigh region 30.

Intermediate Drill 2

Turning to FIGS. 3A-3F, shown therein is the second spacer 12 placed parallel to the trainee's shoulders so that the trainee places both feet on the second spacer 12 while repeating the swing motions described and shown in FIGS. 1A-1F. Once again, the motions are repeated with the trainee standing on the top curved side of the second spacer 12 as well as the bottom flat side of the spacer 12. Such practice increases the trainee's balance while focusing the thigh muscles and the upper body muscles.

Advanced Drill 1

Turning to FIGS. 4A-4F, shown therein is a trainee with one knee 32 placed on the floor with the other leg 34 extended out in front of the body so that a foot 36 is flat on the floor. Each of the swinging exercises shown and described in FIGS. 1A-1F are then repeated. This drill therefore substantially eliminates any stability problems with standing but increases the tension in the thighs 30 and the rear 38 to target the muscles in the thighs 30 and the rear 38 while maintaining the strengthening and stretching of the muscles on the upper body. To increase difficulty, a pliable disc 14 may be placed underneath the knee to provide support while increasing the elevation of the knee 32.

Advanced Drill 2

Turning to FIGS. 5A-5F, shown therein is a trainee with one knee 32 place on the floor and the other leg 34 extended out in front of the body with the foot 36 is resting on the second spacer 12. The elevation of the foot 36 shifts the focus to the muscle opposite thigh while strengthening and stretching the upper body muscles. In an alternate embodiment, both a disc 14 and a second spacer 12 may be used in performing the exercise to increase difficulty.

Advanced Drill 3

Turning to FIGS. 6A-6E, shown therein is a trainee seated on a pliable ball 16 while performing the swinging motions described and shown in FIGS. 1A-1F. This drill allows greater isolation of the lower body so that the movements are even further concentrated on the upper body muscles, providing a more difficult and advanced work-out of such muscles.

Advanced Drill 4

In FIGS. 7A-7F, the trainee is seated on the pliable ball 17 and has one foot 36 elevated on the second spacer 12. As in the kneeling drill, this drill concentrates on providing support for the foot to create stability while increasing the load on the opposite leg, thereby exercising the thigh muscles as well as the upper body muscles. It should be noted that the drill is repeated with the foot 36 placed on both the top curved side and the bottom flat side of the second spacer 12.

Advanced Drill 5

Finally, turning to FIGS. 8A-8F, shown therein is a trainee seated on the pliable ball 16 and with both feet placed on the second spacer 12. Such a drill enhances the effects of the arm movements on the thigh muscles while allowing free movement of the arms to strengthen and stretch the upper body muscles. It should be noted that the drill is repeated with the foot 36 placed on both the top curved side and the bottom flat side of the second spacer 12.

While the invention has been described with particular reference to embodiments relating to the sport of golf, those skilled in the art will appreciate that the invention can be applied to other sports and activities where an accurate and powerful swing is required, especially those sports employing a two-handed swing, for example, baseball, hockey and cricket. A chart detailing the muscle groups exercised are provided hereinbelow.

| | Superficial Muscles Acting at the Scapula | | | | | |
|---|---|---|---|---|---|---|
| Trapezius | Elevation | Depression | Abduction | Adduction | Upward Rotation | Downward Rotation |
| Part 1 | X | | | | | |
| Part 2 | X | | | X | X | |

-continued

| Superficial Muscles Acting at the Scapula | | | | | | |
|---|---|---|---|---|---|---|
| Trapezius | Elevation | Depression | Abduction | Adduction | Upward Rotation | Downward Rotation |
| Part 3 | | | | X | | |
| Part 4 | | X | | X | X | |
| Serratus Anterior | | | X | | X | |

| Deep Muscles Acting at the Scapula | | | | | | |
|---|---|---|---|---|---|---|
| | Elevation | Depression | Abduction | Adduction | Upward Rotation | Downward Rotation |
| Levator Scapula | X | | | | | X |
| Rhomboids | X | | | X | | X |
| Pectoralis Minor | | X | X | X | | X |

| Superficial Muscles Acting at the Humerus | | | | | | | | |
|---|---|---|---|---|---|---|---|---|
| | Flexion | Extension | Abduction | Adduction | Horizontal Abduction | Horizontal Adduction | Inward Rotation | Outward Rotation |
| Deltoid | | | | | | | | |
| Anterior | X | | X | | | X | X | |
| Middle | | | X | | | | | |
| Posterior | | X | X | | X | | | X |
| Pectoralis Major | | | | | | | | |
| Clavicular | X | | X | | | X | | |
| Sternal | | X | | X | | X | X | |
| Coracobrachialis | X | | | X | | X | X | |
| Latissimus Dorsi | | X | | X | X | | X | |
| Teres Major | | X | | X | X | | X | |
| Infraspitiatus | | X | | | X | | | X |
| Teres Minor | | X | | | X | | | X |

| Deep Muscles Acting at the Humerus | | | | | | | | |
|---|---|---|---|---|---|---|---|---|
| | Flexion | Extension | Abduction | Adduction | Horizontal Abduction | Horizontal Adduction | Inward Rotation | Outward Rotation |
| Subscapularis | X | | | | | | X | |
| Supraspinatus | | | X | | | | | X |

It will be clear that the present invention is well adapted to carry out the objects and attain the ends and advantages mentioned as well as those inherent therein. While presently preferred embodiments have been described for purposes of this disclosure, numerous changes may be made which will readily suggest themselves to those skilled in the art and which are encompassed in the spirit of the invention disclosed and as defined in the appended claims.

What is claimed is:

1. A method of swing training for a sport requiring swinging of a sports implement, the method comprising repeated performance by a trainee of at least one swing drill, the at least one swing drill including execution of the following steps:

a) placing one foot on a generally flat, level surface, and placing another foot on a pliable object positioned on the generally flat, level surface, said pliable object providing an unstable support for said another foot;

b) gripping a first elongated spacer between two hands and parallel to a floor;

c) swinging the first elongated spacer in a backswing motion and an opposed downswing motion to bring the first elongated spacer parallel to the floor; and d) swinging the first elongated spacer in a follow-through motion to an opposite side and an opposed downswing motion, wherein placement of said another foot on the pliable object destabilizes the trainee during the swing drill for training proprioceptors utilized during swing movements.

2. The method of claim 1 wherein the backswing motion positions a first arm behind one shoulder and a second arm extended parallel to the floor and the downswing motion positions the second arm behind an opposite shoulder with the first arm extended parallel to the floor.

3. The method of claim 1 wherein the first elongated spacer is a cylindrical pliable object having a diameter between about 20 cm and about 50 cm.

4. The method of claim 1 further comprising the following steps:

e) holding the first elongated spacer between the hands with a first end against trainee's chest so that the hands grip near a second end of the first elongated spacer; and f) swinging the first elongated spacer to one side and an opposed downswing motion; and g) swinging the first elongated spacer to an opposite side and an opposed downswing motion.

5. The method of claim 4 wherein steps e-g are performed with the hands gripping the first elongated spacer at a middle section.

6. The method of claim 1 wherein the pliable object is an elongated pliable object with a top curved side and a bottom flat side and having a diameter between 4 and 40 cm.

7. The method of claim 6 wherein the foot is placed on the top curved side of the pliable object.

8. The method of claim 7 wherein the foot is placed on the bottom flat side of the second spacer.

9. A method of swing training for a sport requiring swinging of a sports implement, the method comprising repeated performance by a trainee of at least one swing drill, the at least one swing drill including execution of the following steps:

a) placing one foot on a generally flat, level surface, and placing another foot on a pliable object positioned on the generally flat, level surface, said pliable object providing an unstable support for said another foot;

b) gripping a first elongated spacer between two hands and parallel to a floor;

c) swinging the first elongated spacer in a backswing motion and an opposed downswing motion to bring the first elongated spacer parallel to the floor so that a first arm extends behind one shoulder during the backswing and a second arm extends parallel to the floor; and d) swinging the first elongated spacer in a follow-through motion to an opposite side and an opposed downswing motion, wherein placement of the another foot on the pliable object destabilizes the trainee such that the swing training method trains the proprioceptors within the trainee's body to improve the trainee's swing.

10. The method of claim 9 wherein the downswing motion positions the second arm behind an opposite shoulder with the first arm extended parallel to the floor.

11. The method of claim 9 wherein the first elongated spacer is a cylindrical pliable object having a diameter between about 20 cm and about 50 cm.

12. The method of claim 9 further comprising the following steps:

e) holding the first elongated spacer between the hands with a first end against trainee's chest so that the hands grip near a second end of the first elongated spacer; and f) swinging the first elongated spacer to one side and an opposed downswing motion; and g) swinging the first elongated spacer to an opposite side and an opposed downswing motion.

13. The method of claim 12 wherein steps e-g are performed with the hands gripping the first elongated spacer at a middle section.

14. The method of claim 9 wherein the pliable object is an elongated pliable object with a top curved side and a bottom flat side and having a diameter between 4 and 40 cm.

15. The method of claim 9 wherein the foot is placed on the top curved side of the pliable object.

16. The method of claim 9 wherein the foot is placed on the bottom flat side of the pliable object.

17. A method of swing training for a sport requiring swinging of a sports implement, the method comprising repeated performance by a trainee of at least one swing drill, the at least one swing drill including execution of the following steps:

a) placing one foot on a generally flat, level surface, and placing another foot on a pliable object positioned on the generally flat, level surface, said pliable object providing an unstable support for said another foot;

b) gripping a first spacer between the hands and parallel to the floor;

c) swinging the first spacer in a backswing motion and an opposed downswing motion to bring the first body spacer parallel to the floor so that a first arm extends behind one shoulder during the backswing and a second arm extends parallel to the floor;

d) swinging the first spacer in a follow-through motion to an opposite side and an opposed downswing motion;

e) holding the first spacer between the hands with a first end against the chest so that the hands grip an opposite end of the spacer; and f) swinging the first spacer to one side and an opposed downswing motion; and g) swinging the first spacer to an opposite side and an opposed downswing motion, wherein the swing drill is repeated with the pliable object under a foot to create an instability so that the body is forced to train the proprioceptors to maintain body stability.

18. The method of claim 17 wherein the first spacer is a cylindrical pliable object having a diameter between 20 and 50 cm.

19. The method of claim 17 wherein steps e-g are repeated with the hands gripping the first spacer at a middle section.

20. The method of claim 17 wherein the pliable object is a pliable disc.

21. The method of claim 17 wherein the second spacer is an elongated pliable object with a top curved side and a bottom flat side and having a diameter between 4 and 40 cm.

22. The method of claim 21 wherein the foot is placed on the top curved side of the pliable object.

23. The method of claim 21 wherein the foot is placed on the bottom flat side of the pliable object.

* * * * *